US005379914A

United States Patent [19]

Martins

[11] Patent Number: 5,379,914

[45] Date of Patent: Jan. 10, 1995

[54] FILTER FOR DRINKING CONTAINER

[76] Inventor: Alvaro F. Martins, 18328 Clarkdale Ave., Artesia, Calif. 90701

[21] Appl. No.: 158,527

[22] Filed: Nov. 29, 1993

[51] Int. Cl.[6] ..... B65D 17/34; A47G 19/22

[52] U.S. Cl. ..... 220/719; 220/729; 220/730; 220/906; 220/269

[58] Field of Search ..... 220/719, 729, 730, 734, 220/906, 268, 269

[56] References Cited

U.S. PATENT DOCUMENTS 3,549,044 12/1970 Lerner ..... 220/719
3,940,012 2/1976 Addington ..... 220/719
4,537,326 8/1985 Morehead ..... 220/269
4,842,157 6/1989 Stone-Parker et al. ..... 220/719
4,938,375 7/1990 Fantacone ..... 220/719 X

*Primary Examiner*—Allan N. Shoap
*Assistant Examiner*—Vanessa Caretto

[57] ABSTRACT

A filtering device for a beverage container with a tab opening system, which acts as a protector for a drink opening of the beverage container, allowing a user to drink through it. The device is not manually activated, and prevents entry of insects or foreign objects, while at the same time filtering beverages enclosed in the container. This filtering device consists of a concave net filter in the shape of half of an egg, which is placed underneath a shearable tab portion of the tab opening system of the container, and is fastened into place by three rivets.

1 Claim, 1 Drawing Sheet

FILTER FOR DRINKING CONTAINER

FIELD OF THE INVENTION

This invention relates to a new filtering device for the aperture of a drinking container, specifically for a can.

BACKGROUND OF THE INVENTION

When drinking from a liquid container after actuating its tab opening device, the container, in this case a can, no longer safely protects the beverage inside. The filter of this invention not only protects the user from choking on residues such as pulp and seeds found in fruit juices, but also from outside matter, an example of which is insects or solid foreign bodies maliciously placed inside the can.

Although the prior art has addressed some of these problems, the solutions have not been entirely successful. One of the solutions has been the removable cover, one that is removed prior to drinking and replaced afterwards. In Moorehead U.S. Pat. No. 4,537,326 the protector for the aperture is manually actuated by the user which allows for error or even breakage of the protector itself.

Thus there is still a need for a filtering device that is part of the can's top lid, which does not interfere with the opening device, and that is not manually activated but instead is ready to be used by the consumer.

SUMMARY OF THE INVENTION

The purpose of the present invention is to provide filtering and protection of the beverage in a liquid container, in this case the well known type which includes a shearable tab which is pivoted into the can along one edge by the pivoted raising of a tab actuator. This purpose is achieved by the novel filtering device of this invention in the form of a concave net shaped as half of an egg, the net being made out of the same material as the can, being recyclable, and being permanently fastened into place by three rivets underneath the top lid of the can under the aperture of the same.

The net is placed underneath the shearable tab portion of the top lid of the can, it does not interfere with the opening system, and it accommodates the tab when actuated. This device filters a beverage from pulp and seeds and protects it from insects and foreign bodies.

DETAILED DESCRIPTION OF THE PREFERRED EMBODIMENT

Figure 1:
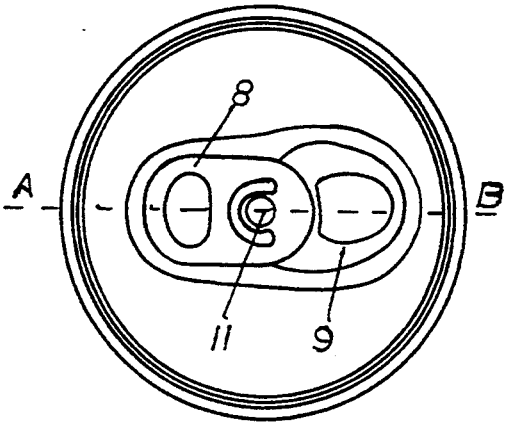
FIG. 1 is a top view of the top lid with the shearable tab in a closed position.
Figure 2:
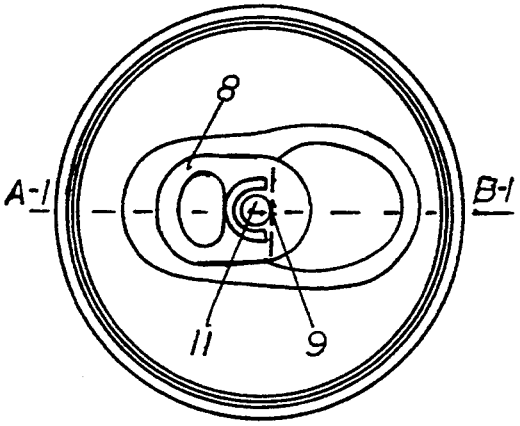
FIG. 2 is a top view of the top lid with the shearable tab in an open position.
Figure 3:
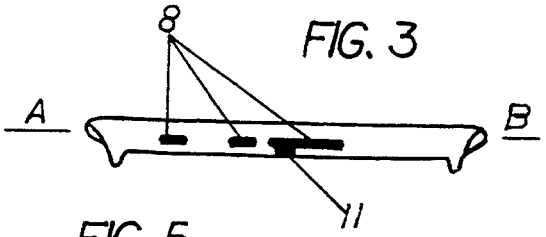
FIG. 3 is a cross-sectional view of the top lid taken through line A–B in FIG. 1.
Figure 4:
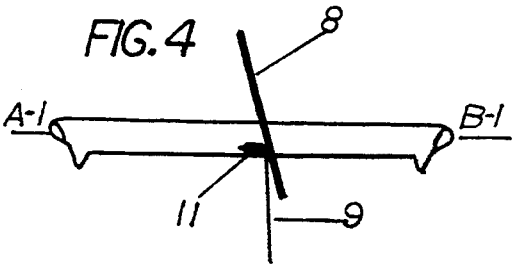
FIG. 4 is a cross-sectional view of the top lid taken through line A1–B1 in FIG. 2.

With reference to the drawings in which like numerals represent like elements throughout the several views, a can 13 is shown having a bottom portion 14 and a top lid. Can 13 is typically a beverage container with a tab actuator 8 attached to the top lid by a rivet 11, and a shearable tab 9 shown in a closed position in FIGS. 1 and 3. The shearable tab 9 is pivoted into the can along one edge by the pivoted raising of the tab actuator 8 to displace the shearable tab and form a drinking opening in the top lid, as shown in FIGS. 2 and 4.

Figure 5:
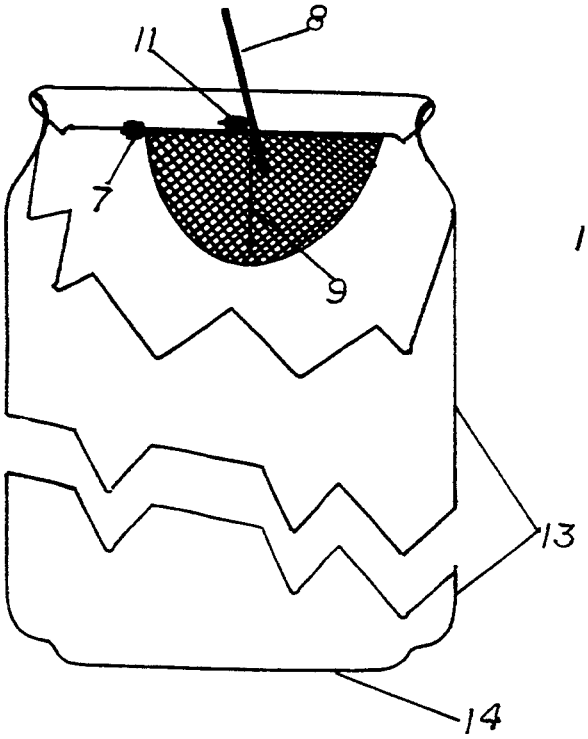
FIG. 5 is a perspective view showing the inside of the beverage container with the filter of this invention in place.
Figure 6:
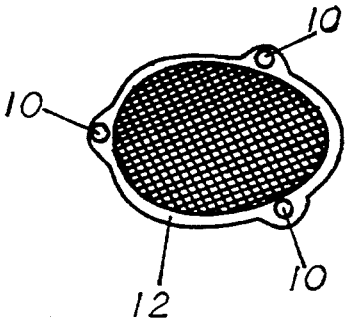
FIG. 6 is a top view of the filter of this invention.

The filtering device of this invention, as shown in FIGS. 5 and 6, is a net filter made of the same material and thickness as the can. The net is fastened to the bottom side of the top lid by rivets 7, and has a net filter lip 12 surrounding the net with an extension lip 10 for placement of the rivets. In operation, the net does not interfere with the tab, and accommodates the tab when actuated into the open position as seen in FIG. 5.

Although the invention has been described in detail with respect to a preferred embodiment thereof, it will be understood that the invention is capable of numerous modifications and variations, without departing from the spirit and scope of the invention.

I claim:

1. A filtering protector for a drink opening in a liquid container comprising:

a lid on the container having a top surface and a bottom surface, a shearable tab closure in said lid, and a tab actuator fastened to said top surface of said lid, wherein said tab actuator is pivotably raised to displace said shearable tab closure from the lid and form the drink opening in said lid; and a concave net filter extending downwardly into the container from said lid, said net filter conforming generally in size to the drink opening of the container, and said net being fastened to said bottom surface of said lid by a plurality of rivets.

* * * * *